US009254514B2

(12) United States Patent
Farnham

(10) Patent No.: US 9,254,514 B2
(45) Date of Patent: Feb. 9, 2016

(54) METHODS AND PROCESSES OF MANUFACTURING TWO PIECE CANS

(71) Applicant: Timothy J. Farnham, East Amherst, NY (US)

(72) Inventor: Timothy J. Farnham, East Amherst, NY (US)

(73) Assignee: Farnham Enterprises, LLC

( * ) Notice: Subject to any disclaimer, the term of this patent is extended or adjusted under 35 U.S.C. 154(b) by 0 days.

(21) Appl. No.: 13/875,743

(22) Filed: May 2, 2013

(65) Prior Publication Data

US 2014/0000333 A1 Jan. 2, 2014

Related U.S. Application Data

(60) Provisional application No. 61/641,808, filed on May 2, 2012.

(51) Int. Cl.
*B21D 22/28* (2006.01)
*B21D 51/26* (2006.01)
*B65D 1/16* (2006.01)

(52) U.S. Cl.
CPC ..... *B21D 22/286* (2013.01); *B21D 51/26* (2013.01); *B65D 1/165* (2013.01)

(58) Field of Classification Search
CPC ..... B21D 22/28; B21D 51/26; B21D 22/30; B21D 22/025; B21D 39/20; B21D 51/2615; B21D 22/201; B65D 1/165
USPC ..... 72/347–349, 370.14, 370.23–370.25, 72/379.4, 46, 463, 464, 47, 415, 60, 63; 413/18, 69, 76
See application file for complete search history.

(56) References Cited

U.S. PATENT DOCUMENTS

| | | | | |
|---|---|---|---|---|
| 4,034,692 | A * | 7/1977 | Hennes | B21D 51/26 72/39 |
| 4,732,031 | A * | 3/1988 | Bulso et al. | 72/348 |
| 4,881,394 | A * | 11/1989 | Jansen | 72/347 |
| 5,050,417 | A * | 9/1991 | Johnson | 72/60 |
| 5,061,140 | A * | 10/1991 | Hamaguchi et al. | 72/349 |
| 5,685,043 | A * | 11/1997 | LaManna et al. | 15/256.52 |
| 5,718,142 | A * | 2/1998 | Ferraro | 72/326 |
| 7,100,415 | B2 * | 9/2006 | Takashima | B21J 5/12 72/335 |
| 7,140,223 | B2 * | 11/2006 | Chupak | B21D 22/28 413/69 |
| 8,511,125 | B2 * | 8/2013 | Reimer | B21D 51/26 72/348 |
| 2004/0185337 | A1 * | 9/2004 | Ishizaki | 72/370.14 |

(Continued)

FOREIGN PATENT DOCUMENTS

| | | | | |
|---|---|---|---|---|
| JP | 05261449 | A * | 10/1993 | B21D 22/28 |

*Primary Examiner* — Shelley Self
*Assistant Examiner* — Pradeep C Battula
(74) *Attorney, Agent, or Firm* — Jennifer Meredith, Esq.; Meredith & Keyhani, PLLC

(57) ABSTRACT

A method of drawing and ironing metal into a can comprising the steps of: feeding a metal roll into a stamper; cutting the metal into circles; forming the circles into cups; feeding the cups into a body maker having a die pack with at least three dies and a punch hard coated to a micro finish between 4 and 12, not cross hatched and is the smallest allowed diameter; spraying a coolant lubricant liquid into the die pack and through the punch; ironing the cup into a thin walled cylinder; trimming the thin walled cylinder; washing, rinsing, drying and decorating the trimmed thin walled cylinder; spray coating the inside of the can with a protective coating; necking the trimmed thin walled cylinder; forming a lip on the top of the tapered thin walled cylinder; testing the trimmed thin walled cylinder for defects; and palletizing the thin walled cylinder.

21 Claims, 11 Drawing Sheets

(56) References Cited

U.S. PATENT DOCUMENTS

2007/0284255 A1* 12/2007 Gorokhovsky et al. ..... 205/89
2009/0217729 A1* 9/2009 Kojima et al. ..... 72/349
2013/0205862 A1* 8/2013 Takahashi ..... B21D 22/286 72/342.3

* cited by examiner

FIGURE 1

12 Oz. Reduction

| Punch (100) | Redraw (102) | 1ST Iron (104) | Pilot (106) | End Iron (108) |
|---|---|---|---|---|
| 2.6042 | 2.6250 | 2.6165 | 2.6200 | 2.6114 |
| 2.6041 | 2.6249 | 2.6164 | 2.6200 | 2.6113 |
| 2.6040 | 2.6248 | 2.6163 | 2.6200 | 2.6112 |
| 2.6039 | 2.6247 | 2.6162 | 2.6200 | 2.6111 |
| 2.6038 | 2.6246 | 2.6161 | 2.6200 | 2.6110 |
| 2.6037 | 2.6245 | 2.6160 | 2.6200 | 2.6109 |
| 2.6036 | 2.6244 | 2.6159 | 2.6200 | 2.6108 |
| 2.6035 | 2.6243 | 2.6158 | 2.6200 | 2.6107 |
| 2.6034 | 2.6242 | 2.6157 | 2.6200 | 2.6106 |
| 2.6033 | 2.6241 | 2.6156 | 2.6200 | 2.6105 |
| 2.6032 | 2.6240 | 2.6155 | 2.6200 | 2.6104 |
| 2.6031 | 2.6239 | 2.6154 | 2.6200 | 2.6103 |
| 2.6030 | 2.6238 | 2.6153 | 2.6200 | 2.6102 |
| 2.6029 | 2.6237 | 2.6152 | 2.6200 | 2.6101 |
| 2.6028 | 2.6236 | 2.6151 | 2.6200 | 2.6100 |
| 2.6027 | 2.6235 | 2.6150 | 2.6190 | 2.6099 |
| 2.6026 | 2.6234 | 2.6149 | 2.6190 | 2.6098 |
| 2.6025 | 2.6233 | 2.6148 | 2.6190 | 2.6097 |
| 2.6024 | 2.6232 | 2.6147 | 2.6190 | 2.6096 |
| 2.6023 | 2.6231 | 2.6146 | 2.6190 | 2.6095 |
| 2.6022 | 2.6230 | 2.6145 | 2.6190 | 2.6094 |
| 2.6021 | 2.6229 | 2.6144 | 2.6190 | 2.6093 |
| 2.6020 | 2.6228 | 2.6143 | 2.6190 | 2.6092 |
| 2.6019 | 2.6227 | 2.6142 | 2.6190 | 2.6091 |
| 2.6018 | 2.6226 | 2.6141 | 2.6180 | 2.6090 |
| 2.6017 | 2.6225 | 2.6140 | 2.6180 | 2.6089 |
| 2.6016 | 2.6224 | 2.6139 | 2.6180 | 2.6088 |
| 2.6015 | 2.6223 | 2.6138 | 2.6180 | 2.6087 |
| 2.6014 | 2.6222 | 2.6137 | 2.6180 | 2.6086 |
| 2.6013 | 2.6221 | 2.6136 | 2.6180 | 2.6085 |
| 2.6012 | 2.6220 | 2.6135 | 2.6180 | 2.6084 |
| 2.6011 | 2.6219 | 2.6134 | 2.6180 | 2.6083 |
| 2.6010 | 2.6218 | 2.6133 | 2.6180 | 2.6082 |
| 2.6009 | 2.6217 | 2.6132 | 2.6170 | 2.6081 |
| 2.6008 | 2.6216 | 2.6131 | 2.6170 | 2.6080 |
| 2.6007 | 2.6215 | 2.6130 | 2.6170 | 2.6079 |
| 2.6006 | 2.6214 | 2.6129 | 2.6170 | 2.6078 |
| 2.6005 | 2.6213 | 2.6128 | 2.6170 | 2.6077 |
| 2.6004 | 2.6212 | 2.6127 | 2.6170 | 2.6076 |
| 2.6003 | 2.6211 | 2.6126 | 2.6170 | 2.6075 |
| 2.6002 | 2.6210 | 2.6125 | 2.6170 | 2.6074 |
| 2.6001 | 2.6209 | 2.6124 | 2.6170 | 2.6073 |
| 2.6000 | 2.6208 | 2.6123 | 2.6170 | 2.6072 |
| 2.5999 | 2.6207 | 2.6122 | 2.6160 | 2.6071 |
| 2.5998 | 2.6206 | 2.6121 | 2.6160 | 2.6070 |
| 2.5997 | 2.6205 | 2.6120 | 2.6160 | 2.6069 |
| 2.5996 | 2.6204 | 2.6119 | 2.6160 | 2.6068 |
| 2.5995 | 2.6203 | 2.6118 | 2.6160 | 2.6067 |
| 2.5994 | 2.6202 | 2.6117 | 2.6160 | 2.6066 |
| 2.5993 | 2.6201 | 2.6116 | 2.6160 | 2.6065 |
| 2.5992 | 2.6200 | 2.6115 | 2.6160 | 2.6064 |
| 2.5991 | 2.6199 | 2.6114 | 2.6160 | 2.6063 |
| 2.5990 | 2.6198 | 2.6113 | 2.6160 | 2.6062 |
| 2.5989 | 2.6197 | 2.6112 | 2.6160 | 2.6061 |
| 2.5988 | 2.6196 | 2.6111 | 2.6160 | 2.6060 |
| 2.5987 | 2.6195 | 2.6110 | 2.6160 | 2.6059 |
| 2.5986 | 2.6194 | 2.6109 | 2.6160 | 2.6058 |

103

107

Continued to next page

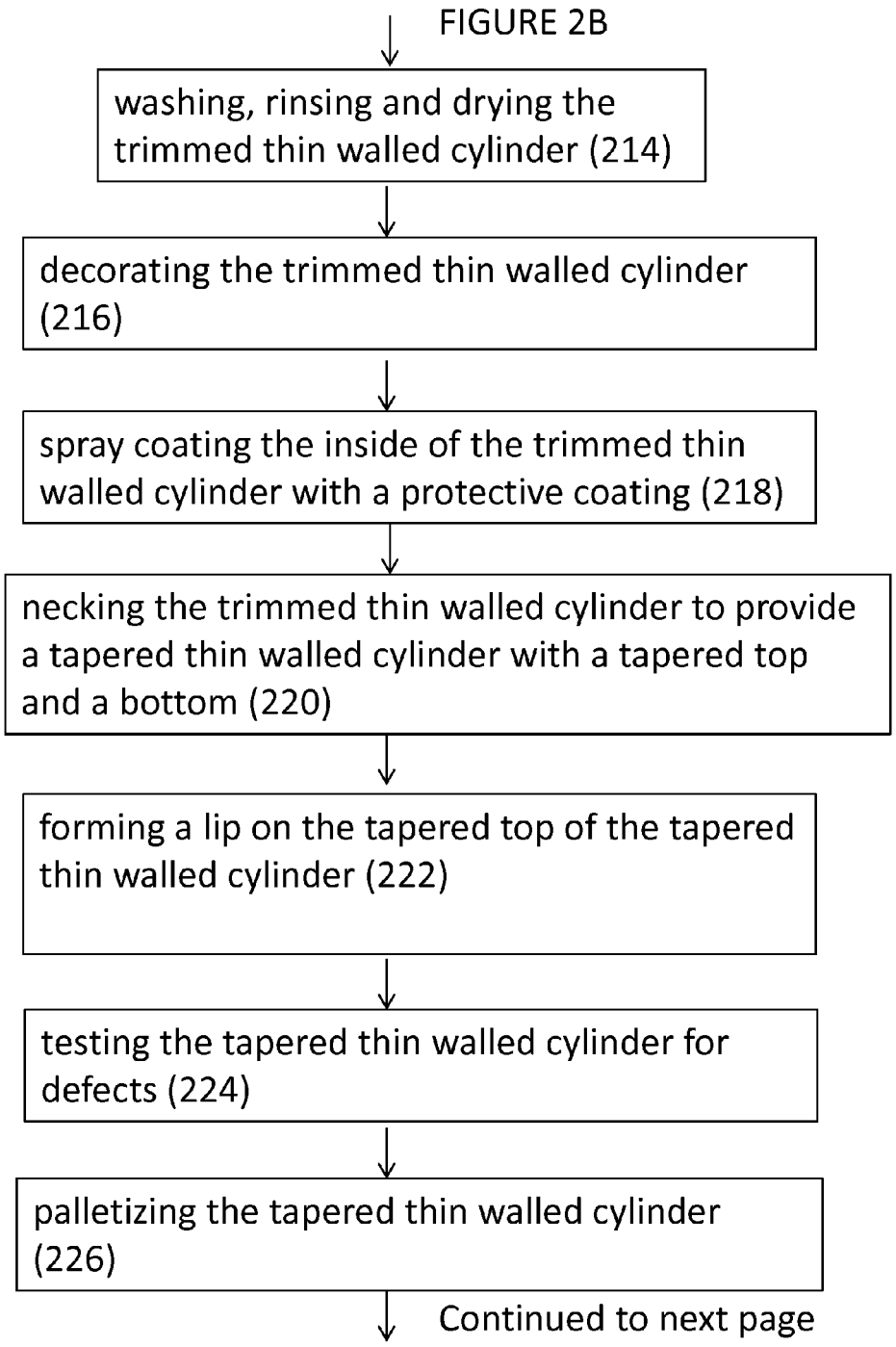
FIGURE 2B
washing, rinsing and drying the trimmed thin walled cylinder (214)
decorating the trimmed thin walled cylinder (216)
spray coating the inside of the trimmed thin walled cylinder with a protective coating (218)
necking the trimmed thin walled cylinder to provide a tapered thin walled cylinder with a tapered top and a bottom (220)
forming a lip on the tapered top of the tapered thin walled cylinder (222)
testing the tapered thin walled cylinder for defects (224)
palletizing the tapered thin walled cylinder (226)
Continued to next page 600
604
602

600

METHODS AND PROCESSES OF MANUFACTURING TWO PIECE CANS

This application claims priority to provisional patent application No. 61/641,808 filed May 2, 2012 and entitled "METHODS AND PROCESSES OF MANUFACTURING TWO PIECE CANS", the entire contents of which are incorporated herein by reference.

Beverages are commonly served in aluminum and metal cans which are made at the pace of more than one million per day. They are generally formed from two pieces: a top (which generally has a tab for opening the beverage) which is generally affixed to a bottom after it is filled with a liquid substance such as a beer or soda. It is desirable to make the can as thin as possible, to reduce material and shipping costs. However, the can itself has to be strong enough to withstand both internal and external pressures. To do so the cylinder section of the can has many curves in its top and bottom to make the can more rigid and able to withstand the internal and external pressures created by internal gases and external axel loads created by stacking and handling.

All two piece cans which the bodies are drawn out of metals of various types such as steel, tin, aluminum and various mixed metals. Depending on the can type and its use will determine what it will be made of. In one example of body making also known as "drawing, ironing or extruding" out the metal of the can we will focus on the 12 oz aluminum can. The process starts out as a roll of 10 gage aluminum that is then pulled off in a continuous sheet and fed into a set of pinch rollers that pulls the aluminum stock off the roll and other rollers put on a coat of cupping oil on the stock as the aluminum gets pulled off the roll. The aluminum is then fed to the cupper with a layer of cupper oil rolled on it to allow the circular disks to be die cut out and stamped into a cup. The cupper oil is there to prevent tearing or pinholes as it forms a cup. The circles or the rounds get pressed it into a round shallow cylinder that is open ended all in one motion that come out the bottom of the machine. These stamped shallow cylinders are referred to as cups in the can industry. The size, shape and thickness of the can vary by the need of metal for the cans. By way of example, the 24 oz can uses a larger or heavier gauge metal than the 8 oz can because it is larger in diameter and longer in size. The same thing goes for the punches that are used to draw the cup made of a thick gage metal down to thin walled cylinder in a process called "ironing or drawing the aluminum thin" as it gets pushed through a series of dies by the punch. These dies are called the redraw (102), then the $1^{st}$ iron (104), then the pilot (106) and finally the end iron (108). The end iron sets the cans side wall thickness to the desired gage or size.

Prior to the present invention, one thing about the punches that change's is the size of the diameter, it gets smaller as it wears. Each punch starts at the maximum allowed diameter (103) for a 12 oz can at 2.6042 inches as shown in the reduction chart FIG. 1. This chart is used by manufacturers to determine the proper dies for the desired gage of aluminum to be drawn out to. The dies recommended for each diameter that it can and it is ground down to smaller size with a tapper at the working end. But with the punch being new and smooth the coolant and lubricant can't sick to it and a static bond would make it difficult for the can to release from the punch once it is completely drawn out. To prevent this from happening the punches are cross hatched with scratches in the metal so that the coolant and the lubricant will have a grove to follow so that coolant and lube would be there to help release the can after it went through the end iron it is pushed off by water pressure along with a rubber ring that catches the edges of the new can as the main shaft draws the punch back to make another can. The can then goes to the trimmer which cuts the can to an exact height and down the rest of the line it goes. Until the cross hatching would wear down and the punch would be sent out to be reground one or two ten thousandths of an inch at a time until it is no longer useful. This is because the punch is made from metal mostly a hardened tool steel like carbide, boron and tungsten that wears down as more and more cans are made from it. So as the exterior of the punch is ground to a smaller size therefore needing a smaller exterior drawing dies. Also down the line there is knecking dies that tapper the top of the can and it starts out at the right size and that depends on the size of the diameter of the can coming out of the body maker. These same size cups continue though, through a continuous conveyer's to various body makers for that size can line. Each line has anywhere from six to seven body makers all depending on the speed of the line which can be differ in speed due to the speed of the light testers or the die-necker's or the number of body makers that feed the line.

At this point the cup is fed to the body maker, a machine that in one stroke pushes a long or short punch. The punch with a forming die at the end is made in one or two pieces, is round and long in shape and correctly sized to form the necessary can body that is correct in diameter and length out of the cup. The process happens as the punch pushes into the thick walled metal cup with bottom side of the cup facing away from the front end of the punch. The punch pushes the cup through the die pack that holds all the four (4) reduction dies in which it assists the punch to go through the draw down dies inside the die pack witch cause the aluminum to heat up as it stretches and it becomes elastomeric as it hits the ironing die at the end of the pack that draws the metal out to a thinner metal wall that takes on the shape of the punch. Making a longer smaller diameter cylinder that continues to be pushed by the ram with a concave die end on it called a re-form die into a mating convex re-formed die that forms the reformed end of the can into a special shape that will allow enough expansion and contraction allowed by the bottom dome of the can during the pasteurizing process that takes place in the can itself. The punch does this in one stroke till it is pushes the can body completely out of the die pack into the reform die as the punch retracts thus releasing the can off of the punch with fluid and air pressure breaking the static bond between the can and the punch. Then it is released on to another conveyer that takes it to be trimmed to the correct height or length suitable for the application by a machine called the trimmer. This action is called body making or ironing metal to form a can with a reform dome on the bottom beverage in this case. Food cans are different than dog and cat food cans which are different than tuna cans but the punch and dies work the same ways to draw out the metal to the shape it need to be for the consumer.

During the body making process the punch is being sprayed with lubricant and coolant that helps cool the metal as it is being thinned down during a high fiction process so that it does not discolor the metal due to heat allowing the metal to stay smooth on the exterior. The interior of the can reflects the cross hatching that is on the punch that is put on so that the lubricant and cooling has groves or veins to stay in so that the can will release and slide off the punch. The can then goes via a conveyer to the can washer to remove the oily coolant and lubricant from the outside and inside of the can. After that wash the can goes through an etching wash that uses acids and other corrosive chemicals to ensure that the can will accept inks for decorating and to remove as much of the dirty cross hatching from the inside of the can so a clear coat will adhere to the surface. Sometimes the cross hatching will be deep enough that the acid washing will cause pinhole's in the can wall. Acid etching the entire can causes metal wasting by removing the metal in measureable amounts like tenths of a gram. In the end the can goes through a rinse to remove residues left from previous processes causing chemicals, acid along with heavy metals to contaminate the rinse and wash water and it has to be removed at the expense of the manufacturers. These waste waters go through a reclamation process to remove the heavy metals and hazardous chemical. Acid etching process removes the metal that can cause the can wall to be thin enough to cause what is known as pin holing. Pin holing leaves the can to be recycled and a loss to the total production thus meaning a higher percentage of waste to good cans produced. The cross hatching can cause the punch to get sludged up with burned coolant waste and lube making it harder for the cans static contact to release. So the current process has the can industry polluting more water, adding more heavy metals to the our water as well, the cooling process is ineffective and causes the punch to sludge up and not working properly along with causing cross hatching inside of the can which leads to acid etching and material waste. The current process only works using carbide punch's that are cross hatched and the drawing dies and ironing die is carbide as well. So can manufactures start off with a punch that they cross hatch and then send out to be ground down and then cross hatched again. This goes on in ten thousands of an inch at a time till they remove 5 to 6 thousandth of an inch off the punch and it is considered unusable. So every time they grind a die it changes the drawing die's and the ironing die's size along with taking the time to change the dies to various sizes.

The following provides an overview of the two piece can process and how it is defective. The making of the two piece can from sheet to finish on to the paletizer: (1) The metal comes on a roll all the same gage or thickness and width and it is fed into the stamper. (2) In the die stamper it cuts the metal into circles and forms the metal circles into a cup. The cups continue onto the correct size line of body makers. (3) Body makers are fed the cups and the cups go into a pocket in front of a A: "die pack" the back of the cup is facing the die pack and the open end of the cup is facing the cross hatched B: "punch" the body maker pours and sprays a coolant lubricant liquid throughout the die pack and the punch to help iron the metal of the cup into a thin walled shinning cylinder which is called the C: "body of the can" by slamming the punch into the cup past the formers pulling down the wall size of the cup and past the second formers and then though the ironing die drawing it out into a can cylinder and pushing it off with fluid pressure as the punch retracts leaving cross hatching marks on the inside of the can as it goes on to the trimmer. (4) The trimmer cuts the cylinder down to the right height and is put upside down onto a mesh conveyer where it goes through a washer. (5) At the washer the can goes through a high temperature wash and then though an acid wash or acid etch where the wall thickness is reduced to a thinner size. Then the can goes through a rinse bath washing off the acid residue and the metal into the rinse water or gray water. This gray water has to reclamation process that is very expensive as well as the chemicals they use to clean and etch the can. (6) The cans then go through a dryer drying them off and onto the decorator where the can is decorated. After the decorating it goes through a pin dryer where the cans ride on metal pins as they go through a Tall long oven in a multiple "S" patterns until the coating is dry. (7) The cans go through the spin flanger to the sprayer to the die necker. (8) At the die necker depending on the body maker punch size that will determine the die necker size as well. So we currently have multiple size dies. To fit multiple size cans from the multiple size punches. (9) To the light tester where the can has its second to last chance to be checked for pin holes (an imperfection commonly caused by dome cracks caused during body making). Then after that it goes through some visual inspectors and if it has a tiny dent that will reduce the axel load of the can and reject it or a flange dent put in at the light tester. (10) To palletizing, here is where the cans get stacked on sheets of plastic so that they can easily slide off at the filler where the can is filled with product such as juice, soda, beer or even water or wine. This is the process and its many flaws that have been used time and time again.

These and other features, aspects and advantages of the present invention will become better understood with reference to the following description and claims.

SUMMARY OF THE INVENTION

The present invention relates generally to methods and processes of assembling two piece cans.

According to one embodiment, a method of drawing and ironing metal into a can for beverages, food and products, the method comprising the steps of: feeding a metal roll into a stamper; cutting the metal into circles; forming the circles into cups; feeding said cups into a body maker, wherein said body maker has a die pack and a punch that is hard coated to a micro finish between 4 and 12, is not cross hatched and is the smallest allowed diameter; spraying a coolant lubricant liquid into the die pack and the punch; ironing the cup into a thin walled cylinder; trimming the thin walled cylinder to provide a trimmed thin walled cylinder; washing, rinsing and drying the trimmed thin walled cylinder; decorating the trimmed thin walled cylinder; spray coating the inside of the can with a protective coating; necking the trimmed thin walled cylinder to provide a tapered thin walled cylinder; forming a lip on the top of the tapered thin walled cylinder; testing the trimmed thin walled cylinder for defects; and palletizing the thin walled cylinder.

These and other features, aspects and advantages of the present invention will become better understood with reference to the following description and claims.

BRIEF DESCRIPTION OF THE DRAWINGS

FIG. 1 depicts a chart showing a reduction for a 12 ounce can;

FIGS. 2A, 2B and 3C depict a flow chart according to the present invention;

FIGS. 3A, 3B and 3C depict the present invention;

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

With reference to FIGS. 2-6, the present invention provides many innovations to reduce the cost of the can, reduce the amount of aluminum in a can, and eliminate hazardous chemicals into our already overburdened ecosystem of our fresh water and reducing the carbon foot print in making the most recycled container (the aluminum can). The present invention solves problems in the body maker through novel ways to help eliminate many undesirable practices and simplify them with a coating on the parts and standardization of the punches and external dies at the minimum size diameter. The following provides a breakdown of the methods and processes according to the present invention. By saving metal, eliminating heavy metal in the water and saving costs on chemicals like acid that make waste water very expensive to eliminate and treat and in the end leaving less of a carbon footprint and more profit in cans, the world's number one recycled product.

At the beginning of the process, the metal comes in a roll all the same gage but now the gage is its thinner because you need less metal to make a can but the width remains the same and it is fed into the stamper. The metal gage is thinner for one reason, the cans are being made of the smallest diameter punch it can use so there is in the circle 5 to 6 thousands of an inch less metal, in this case we will use aluminum. It should be noted that the gage will vary according to the need of the resulting can, but in all cases it is less than it would have been in the past because the starting diameter of the punch does not change and starts at the smallest diameter instead of starting at the largest diameter and being word down to the smallest diameter (as in the prior art).

Figure 7:
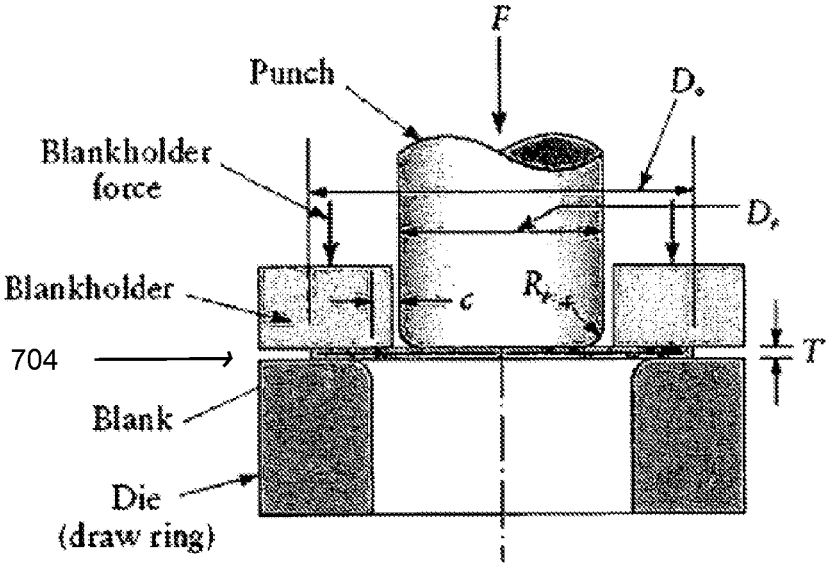
FIG. 7 depicts a sample of the set up according to the present invention.

The die stamper cuts the aluminum into circles and forms the metal into a cup. The cup continues onto the correct size line of body makers. The body makers are fed the cups and the cups go into the pocket in front of the A:"die pack" the back of the cup is facing the die pack and the open end of the cup is facing the unhatched or non-cross hatched B:"punch." The die pack has at least three dies and typically has three or four dies. FIG. 7 shows an example of a die. This time the punch is not cross hatched it is ground to a 10 to 14 finish and it is ground the smallest size allowed by the fillers for the can so it uses an outside diameter smaller by 6 to 8 thousands of an inch, meaning a 12 oz can will use 0.8 grams less of aluminum per can. The at least three dies and the punch are hard coated with two elements Boron and another hard molecule such as titanium and or carbon though a vapor deposition in a vacuum chamber that puts a hard coating on the punch that leaves a hard shell 3800 vectors twice the hardness of the hardness Rockwell. This coating allows you to not cross hatch the punch due to hardness and lubricity of the coating. The body maker pours and sprays a coolant lubricant liquid into the die pack and the one or two piece punch to help iron the metal of the cup into a thin walled shinning cylinder that is shining on the inside of the can due to the fact that there is no cross hatching transfer from the punch on the inside of the can because the punch no longer has to have cross hatching on it. D: Due to the coatings lubricity and the lack of cross hatching the punch should have no load up with burnt coolant and lube. Also, now the coating will wear rather than the punch so you can then standardize the size of the punch and die process for every can by coating both the punch and the exterior punches as the coating wears you pull them out and send them to recoating and put in another set you have on the shelf. E:*Another benefit will be that the punch surface and the exterior die surface will last longer making the swap less frequent reducing the carbon foot print of the shipping process. The trimmer it cuts down the cylinder to the correct height and it puts the can upside down onto a mesh conveyer where it goes though the washer. At the washer the can goes though the warm soapy water washer to remove any coolant or lube used during the washing process and then though the rinse and on to the dryer. * now the can no longer has to go through the acid etching process and there for there will be no more severe metal wasting of aluminum of 0.8 gams on a 12 oz can and increased chances of pin holing and the dome fractures of the can. Eliminating this step and changing it to a wash cycle to a mild acid like of a lemon juice instead. This step in the process also helps reduce cost of chemicals and gray water elimination. These are additional saving along with the energy cost of the process. After the decorator the cans go off on to decorating where the can is decorated and then clear coated and put on to a pin dryer that runs the can through a series of s's in the oven to dry the inks and clear coating. A:* now that the can is reduced in diameter by 5 to 6 thousands of an inch this means there is less surface to clear coat, to dry, less aluminum used and a thinner can's making it easier to dry and in a industry where they in the United States alone make 140 Billion cans you are making a difference of magnitude in every area of the process a huge magnitude to the cost and the environment to an already environmentally great product. The endlessly recycled product the aluminum can. The cans go through a spin flanger that leaves a lip to get rolled up while putting on the lid after filling. The lip is added after the can goes though the die necker that tappers down the top of the can to the right size so that the lid will fit on tight. A:*Now that the punch and dies are standard sized so are the cans making not a need to change the size of the necking dies so that they will all have the same opening in the end saving millions in dies alone in the die necking process putting even more new found money on the table to the manufactures. But only by changing the process and standardizing tools a die used in the industry today can it be done. Now normally you would see a minimum of 4 to ten percent loss of cans produced and it happens at the vision systems at the end of the necker. So imagine to create 140 billion cans you would have to waste 7 to 10 billion cans to be recycled. Even being recycled it's a huge carbon foot print that is virtually eliminated. On to the light testers where commonly you see the blue mule square clamp rod assemblies being use to give the can a greaseless process on which it can be checked to see if there are any dome fractures or pin holes in the can that would have commonly caused by A:* Acid washing putting pinholes in the cans and dome fractures caused by the punch having a buildup of sludge in the cross hatchings. But now with a hard lubricous coating this won't happen so commonly so more cans should pass easily and be sent on to palletizing. At Palletizing, the cans get stacked on sheets of plastic so that they can easily slide off on to the filling conveyor where the can is filled with products such as juice, soda, beer or even water or wine. So there it is a process with less flaws that standardizes the sizes of the tooling and punches by coating them with a hard protective lubricous surface all the while standardizing the can. In the end of this process we will have saved millions of tons of aluminum about 20 million tons per 40 billion aluminum can manufactured so in the USA alone it equals to 60 million tons of aluminum @ $2,000.00 a ton in this case.

The cost of regrinding the dies and having so many various sizes by standardizing the vary punches and outer dies that make them. Saving the need of acid etching only used in chrome plating and its being banned practically everywhere in the United States as it should. Also eliminating heavy metal contamination that effects our already grossly polluted waters. These processes only polish a great idea though its many novel ways to a product that is the best recycled product in the world. Along standardizing the punches and dies I have another novel idea that would change the taper of the punch towards the bottom to help pull more metal out of the bottom of the can and draw it up to the side walls. The aluminum at the bottom of the can consistently is thicker than the side walls and that aluminum is being wasted because it is not needed in the bottom of the can. Again this will be achieved by changing the angle of the domer on the bottom of the punch and the side walls of the punch together with reducing the gage you start off with will achieve a saving of another 0.6 gram of aluminum per can.

The present invention standardizes the punches to the smallest size for all types of containers The present invention also uses different types of vapor deposition coatings on the punch and draw down die's to eliminate the cross hatching on the inside of the can. These steps allow the manufacturers to start with a thinner gage of aluminum to achieve a solid thinner side wall of the can eliminating the concerns of pin holing while reducing the amount of aluminum used to make the can. Changing the domer angle and the angle on the side of the punch you can pull more metal out off the bottom of the can up to the side walls. This again allows the use of even thinner gage of aluminum used to make a aluminum can. These ideas save all together about 1.8 to 2 grams of aluminum per 12 oz can reducing the carbon foot print even more of the aluminum can.

With references to FIGS. 1, 2, 3A, 3B, 4A, 4B, 4C, 4D, 4E, 5A, 5B, 5C, 5D, 5E, 5F, 5G, 6A, 6B, 6C, 6D, and 7 a method of drawing and ironing metal into a can for beverages, food and products is provided, the method comprising the steps of: (200) feeding a metal roll into a stamper; (202) cutting the metal roll into circles; (204) forming the circles into cups; (206) feeding the cups into a body maker, wherein the body maker has a die pack with at least three dies and a punch (116) the at least three dies and the punch are hard coated to micro finish between 4 and 12, the punch (116) is not cross hatched and is the smallest allowed diameter (107); (208) spraying a coolant lubricant liquid into the die pack and the punch; (210) ironing the cup into a thin walled cylinder; (212) trimming the thin walled cylinder to provide a trimmed thin walled cylinder; (214) washing, rinsing and drying the trimmed thin walled cylinder; (216) decorating the trimmed thin walled cylinder; (218) spray coating the inside of the trimmed thin walled cylinder with a protective coating (by way of example this may be an epoxy-based organic protective coating that prevents the contents (such as a beverage) from reacting with the metal of the inner surface of the can body); (220) necking the trimmed thin walled cylinder to provide a tapered thin walled cylinder with a tapered top and a bottom; (222) forming a lip on the tapered top of the tapered thin walled cylinder; (224) testing the tapered thin walled cylinder for defects; and (226) palletizing the tapered thin walled cylinder. FIG. 7 depicts a place where the coolant lubricant liquid is sprayed (spray mark 704) into the die pack and the punch.

The method may further comprise the steps of: (228) filling the thin walled cylinder with product to provide a filled thin walled cylinder; and (230) sealing a lid on the top of the filled thin walled cylinder. As would be understood by one of ordinary skill in the art these steps may be performed at a different facility by a different party.

The metal roll is a continuous aluminum roll with a reduced gage compared to methods using uncoated and cross hatched punches. This is to say that by utilizing the method of the present invention, the metal roll will always be capable of being a lesser gage (thickness) as compared to prior art methods. The exact gage depends on the desired can, but because the punch starts at the smallest allowable size a lesser gage metal roll may be used. In should be noted that the punch (116) starts and remains at the smallest allowed diameter as dictated by the filler. Instead of the punch (116) being worn down, the micro finish is worn. The punch (116) (and the dies) are hard coated to a micro finish between 4 and 8, preferably 6 RMS microinches. The thickness of the hard coating may be between 1 mil. and 8 mil, preferably 4 mil. According to one embodiment, the punch and the dies are hard coated with diamond like coating (DLC) mixed with Boron and titanium through a vapor deposition in a vacuum chamber using a gas (for example, nitrogen, helium, nitrogen oxygen). According to another embodiment, the punch (116) and the dies are hard coated with diamond like coating (DLC) mixed with Boron and carbon through a vapor deposition in a vacuum chamber using a gas.

Figure 4A:
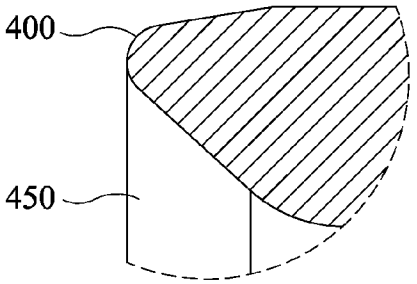
FIGS. 4A, 4B, 4C, 4D and 4E depict the present invention.
Figure 4B:
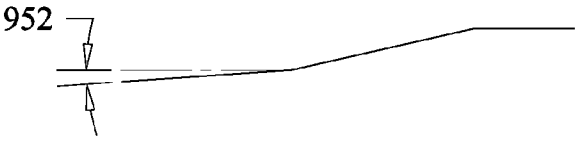
Figure 4C:
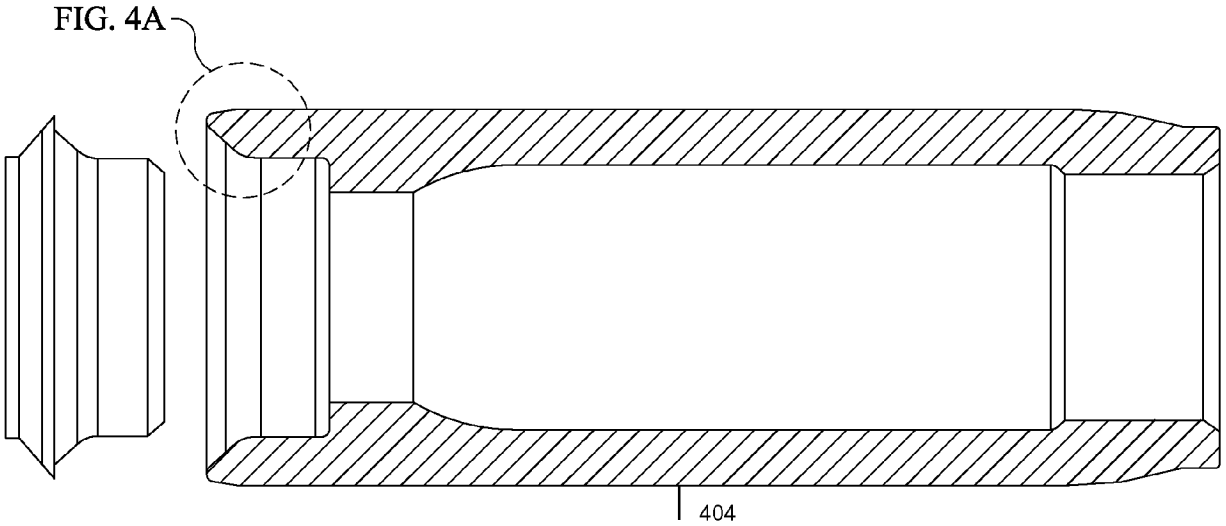
Figure 4D:
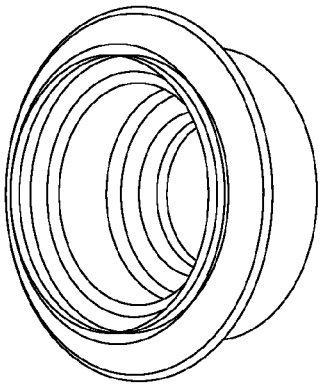
Figure 4E:
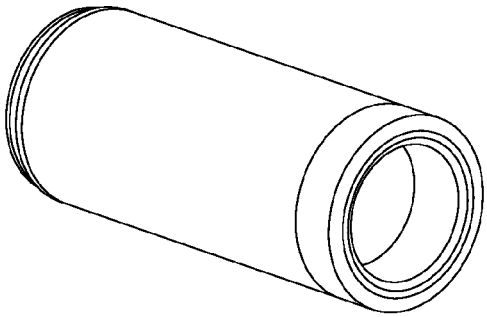
Figure 5A:
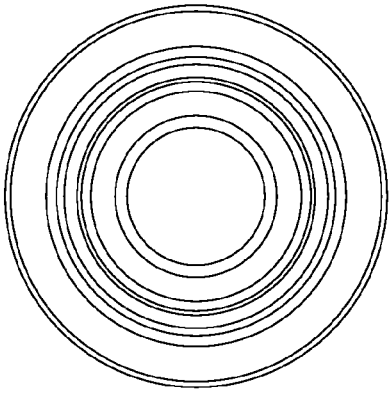
FIGS. 5A, 5B, 5C, 5D, 5E, 5F and 5G depict the present invention.
Figure 5B:
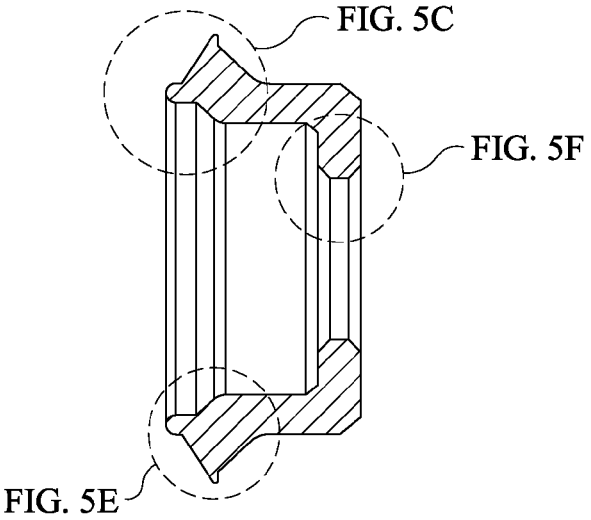
Figure 5C:
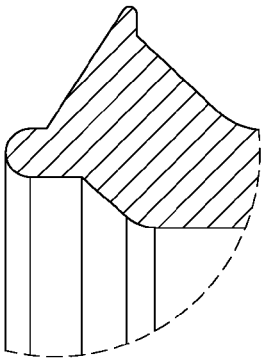
Figure 5D:
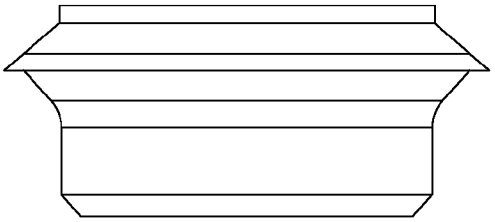
Figure 5E:
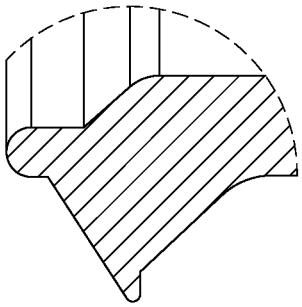
Figure 5F:
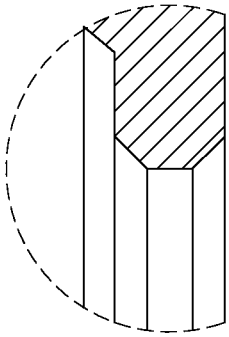
Figure 5G:
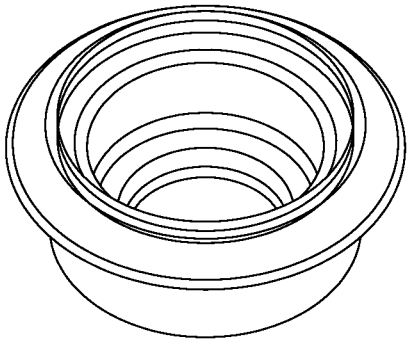

The punch may be a one-piece or two-piece punch having a cylindrical portion and a domer nose portion. If the punch is a one-piece punch the cylindrical portion and a domer nose portion are formed as an integral one-piece punch. In the case of a two-piece punch, as shown in FIG. 4*c*, the domer nose portion (400) and the substantially cylindrical portion (402)

Figure 2A:
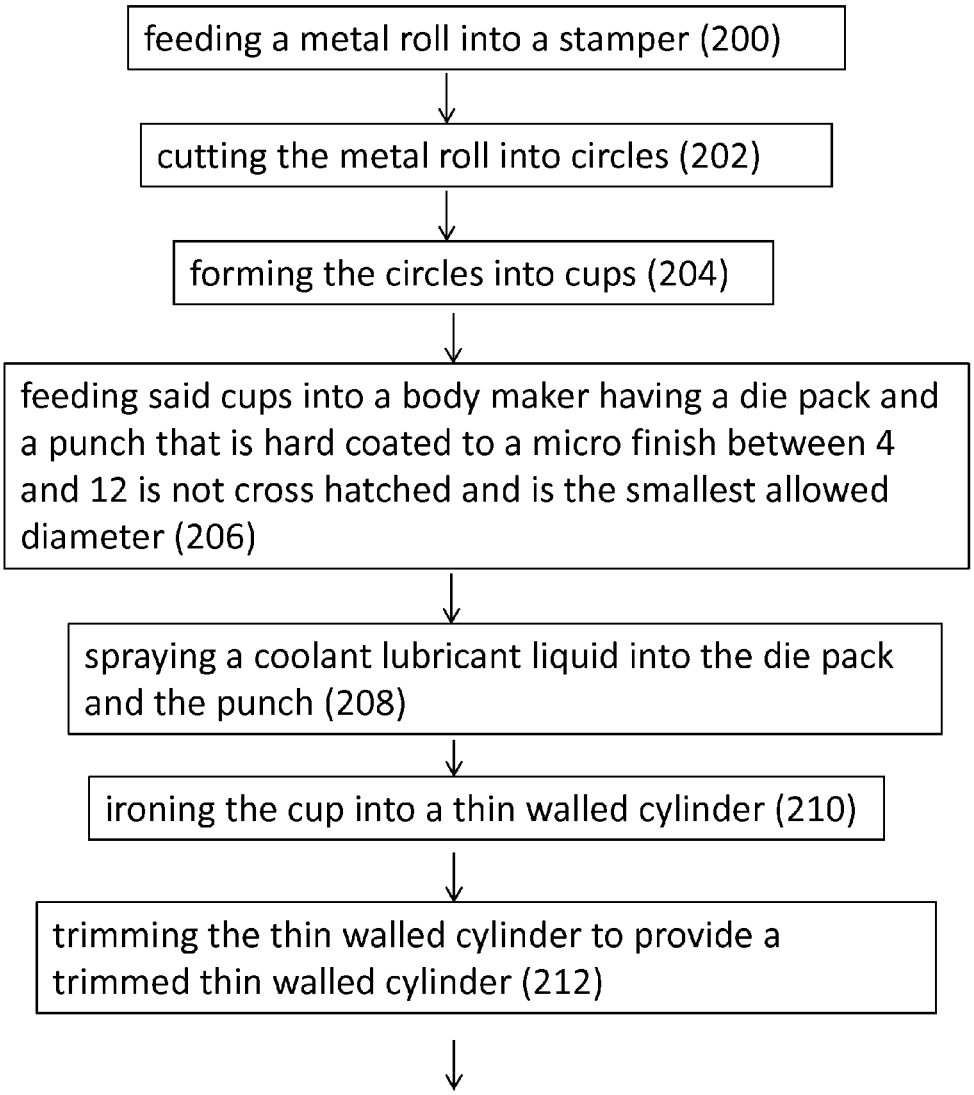
Figure 2C:
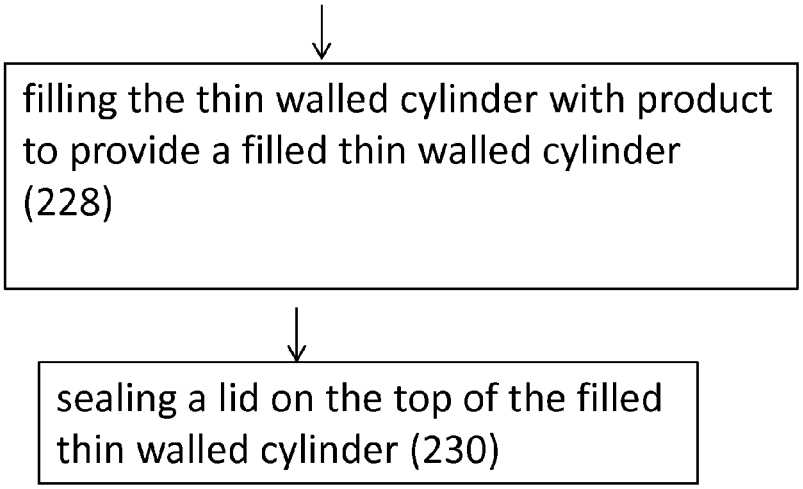
Figures 3A, 3B, 3C:
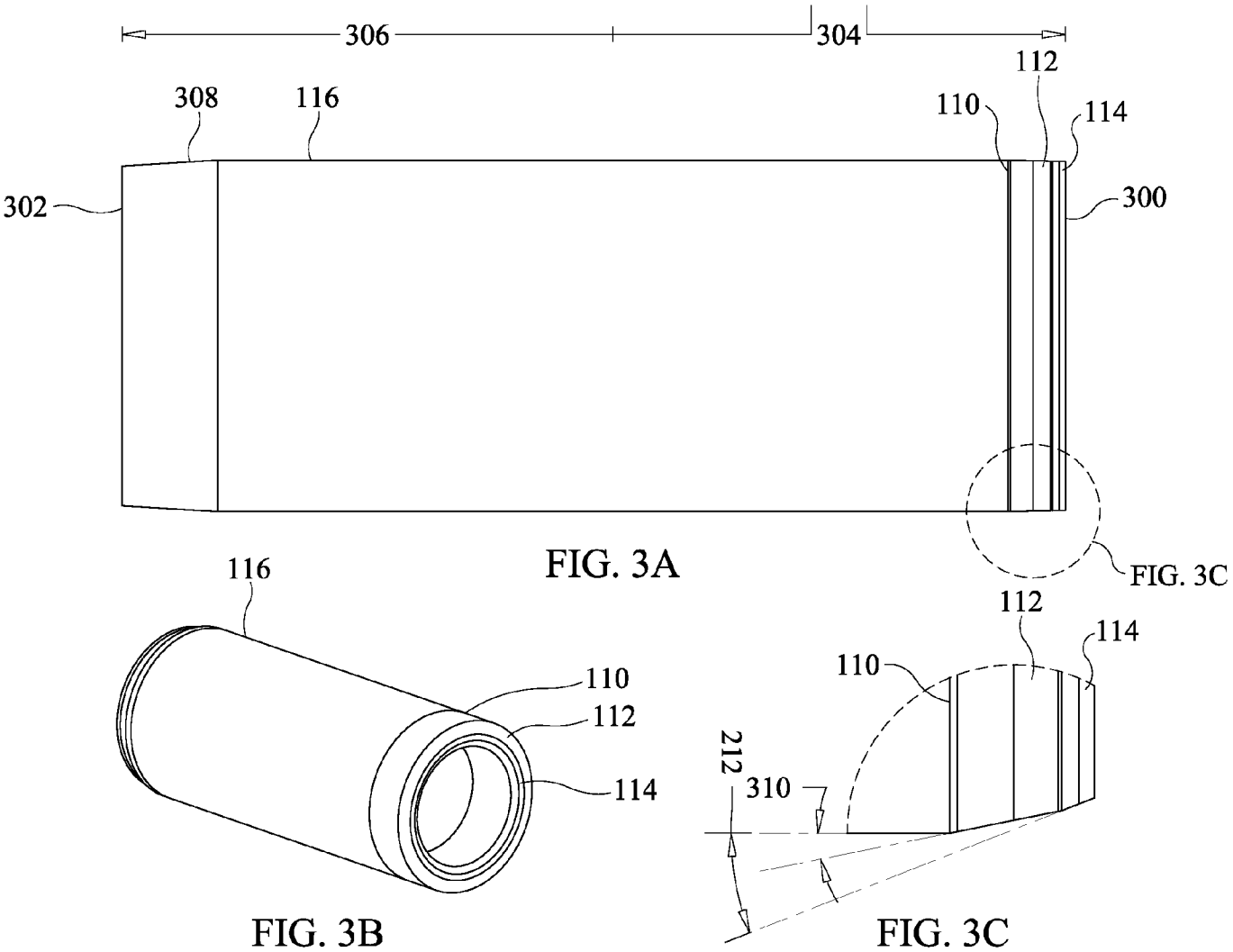
Figures 6A, 6B, 6C, 6D:
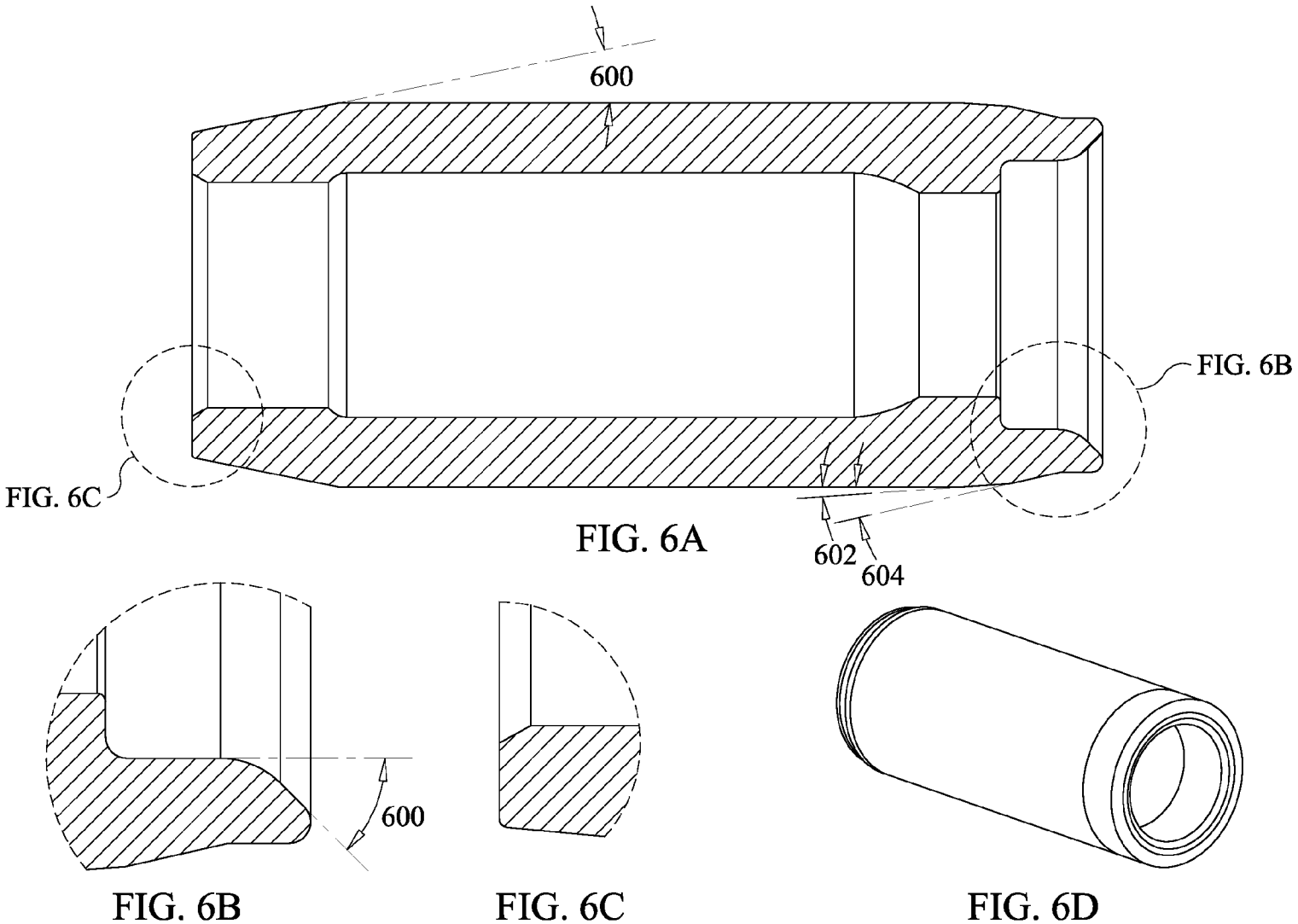
FIGS. 6A, 6B, 6C and 6D depict the present invention.

As shown in FIGS. 3A and 3B, the punch has a front portion (304) with a front edge portion (300) and a rear portion (306) with a rear edge portion (302) The rear portion (306) may be tapered from a rear transition point (308) to the rear edge portion (302) at an angle (as seen in FIG. 6A as angle 600) between 1 and 5 degrees, preferably between 2.5 and 2.6 degrees.

As shown in FIGS. 3A and 3D, the front portion (304) may have at least two concentric tapered portions (112, 114). The front portion has a front edge portion that is ground at an angle (as seen in FIG. 3B as angle (310) and FIG. 6A as angle (602)) which may be between 0.5 degrees and 4 degrees, more specifically between 0.5 and 2 degrees and preferably between 1.4 and 1.8 degrees to provide a first concentric taper. This may be seen in FIG. 4A, as rounded edge (400). There may also be a radius (110) ground into the front portion of the punch. The radius prevents a sharp transition which would prevents tear offs. There may also be a second concentric taper (112) behind the first concentric taper (114) and at an angle (as seen in FIG. 3B as angle (312) and FIG. 6A as angle (604)) between 1 and 4 degrees.

As shown in FIGS. 4A, 4B, 4C, 4D and 4E, the punch (400) has a front portion (402), midway transition point (404), and rear portion (406) and the diameter of the punch has a step down from the midway transition point (404) to front portion (402). The step down in the diameter is so small that it may be not be capable of being seen but it should be understood that the diameter at the midway transition point (404) is larger than at the front portion (402). The midway transition point (404) may be at substantially halfway between the front portion and the rear portion. This may vary widely, though, with the midway point being at a point anywhere between one third and two thirds of the distance from the front portion (402) to the rear portion (406). The step down may be between 0.05 and 30 degrees, preferably between 0.05 degrees and 10.5 degrees (this may be seen in FIG. 4B as angle (452)). According to another embodiment, the step down is between 11.5 degrees and 30 degrees.

The domer nose may have a domer angle of substantially 45 degrees. This may be seen in FIG. 4A as angle (450) and FIG. 6B as angle (600).

It should be understood that the foregoing relates to preferred embodiments of the invention and that modifications may be made without departing from the spirit and scope of the invention as set forth in the following claims.

A method of drawing and ironing metal into a can for beverages, food and products, the method comprising the steps of: feeding a metal roll into a stamper; cutting the metal into circles; forming the circles into cups; feeding said cups into a body maker, wherein said body maker has a die pack having at least three dies and a punch, wherein the at least three dies and the punch are hard coated to a micro finish between 4 and 12, and the punch is not cross hatched and is the smallest allowed diameter; spraying a coolant lubricant liquid into the die pack and the punch; ironing the cup into a thin walled cylinder; trimming the thin walled cylinder to provide a trimmed thin walled cylinder; washing, rinsing and drying the trimmed thin walled cylinder; decorating the trimmed thin walled cylinder; spray coating the inside of the can with a protective coating; necking the trimmed thin walled cylinder to provide a tapered thin walled cylinder; forming a lip on the top of the tapered thin walled cylinder; testing the trimmed thin walled cylinder for defects; and palletizing the thin walled cylinder.

I claim:

1. A method of producing a can for beverages, food and products, said method comprising the steps of:

feeding a metal roll into a stamper;

cutting the metal roll into circles;

forming the circles into cups;

feeding said cups into a body maker, wherein said body maker has a die pack having at least three dies and a punch, wherein the at least three dies and the punch are hard coated to a micro finish between 4 and 12, and the punch is not cross hatched and has a diameter that is the smallest allowed diameter;

spraying a coolant lubricant liquid into the die pack and the punch;

ironing the cup into a thin walled cylinder;

trimming the thin walled cylinder to provide a trimmed thin walled cylinder;

washing, rinsing and drying the trimmed thin walled cylinder;

decorating the trimmed thin walled cylinder;

spray coating the inside of the trimmed thin walled cylinder with a protective coating;

necking the trimmed thin walled cylinder to provide a tapered thin walled cylinder with a tapered top and a bottom;

forming a lip on the tapered top of the tapered thin walled cylinder;

testing the tapered thin walled cylinder for defects; and palletizing the tapered thin walled cylinder.

2. A method as in claim 1, further comprising the steps of:

filling the thin walled cylinder with product to provide a filled thin walled cylinder; and sealing a lid on the top of the filled thin walled cylinder.

3. A method as in claim 1, wherein said metal roll is a continuous aluminum roll with a reduced gage compared to methods using uncoated and cross hatched punches.

4. A method as in claim 1, wherein said wherein the at least three dies and the punch are hard coated are ground to a micro finish between 4 and 8.

5. A method as in claim 1, wherein said punch that starts and remains at the smallest allowed diameter as dictated by a filler.

6. A method as in claim 1, wherein the at least three dies and the punch are hard coated with diamond like coating (DLC) mixed with Boron and titanium through a vapor deposition in a vacuum chamber using a gas.

7. A method as in claim 1, wherein the at least three dies and the punch are hard coated hard coated with diamond like coating (DLC) mixed with Boron and carbon through a vapor deposition in a vacuum chamber using a gas.

8. A method as in claim 1, wherein said punch is a two-piece punch having a substantially cylindrical portion and a domer nose portion.

9. A method as in claim 1, wherein said punch is a one-piece punch having a substantially cylindrical portion and a domer nose portion formed as an integral one-piece punch.

10. A method as in claim 1, wherein said punch has a front portion with a front edge portion and a rear portion with a rear edge portion.

11. A method as in claim 10, wherein said rear portion is tapered from a rear transition point to the rear edge portion at an angle between 1 and 5 degrees.

12. A method as in claim 10, wherein said front portion has at least two concentric tapered portions.

13. A method as in claim 12, further comprising a second concentric taper behind said first concentric taper and at an angle between 1 and 4 degrees.

14. A method as in claim 10, wherein said front portion has a front edge portion that is ground at an angle between 0.5 degrees and 4 degrees.

15. A method as in claim 10, further comprising a radius ground into the front portion of the punch.

16. A method as in claim 10, further comprising a domer nose having a domer angle of substantially 45 degrees.

17. A method as in claim 1, wherein said punch has a front portion, midway transition point, and rear portion and the diameter of the punch has a step down from the midway transition point to front portion.

18. A method as in claim 17, wherein said midway transition point is at substantially halfway between the front portion and the rear portion.

19. A method as in claim 17, wherein said step down is between 0.05 degrees and 10.5 degrees.

20. A method as in claim 17, wherein said step down in between 11.5 degrees and 30 degrees.

21. A method as in claim 1, wherein the at least three dies and the punch are hard coated to a micro finish between 4 and 12 and having a hard coating that is between 1 mil. and 8 mil.

* * * * *